US012065851B2

(12) United States Patent
Saltijeral

(10) Patent No.: US 12,065,851 B2
(45) Date of Patent: Aug. 20, 2024

(54) ENHANCED SECURITY FENCE AND METHOD OF CONSTRUCTION AND INSTALLATION

(71) Applicant: Industrial Fence, Inc., Chicago, IL (US)

(72) Inventor: Miguel A Saltijeral, Oswego, IL (US)

(73) Assignee: Industrial Fence, Inc., Chicago, IL (US)

( * ) Notice: Subject to any disclaimer, the term of this patent is extended or adjusted under 35 U.S.C. 154(b) by 0 days.

(21) Appl. No.: 17/582,725

(22) Filed: Jan. 24, 2022

(65) Prior Publication Data

US 2022/0145661 A1 May 12, 2022

Related U.S. Application Data

(62) Division of application No. 15/804,500, filed on Nov. 6, 2017, now Pat. No. 11,261,617.

(60) Provisional application No. 62/419,706, filed on Nov. 9, 2016.

(51) Int. Cl.
*E04H 17/16* (2006.01)
*E04H 17/00* (2006.01)

(52) U.S. Cl.
CPC ..... *E04H 17/166* (2013.01); *E04H 17/003* (2013.01)

(58) Field of Classification Search
CPC ... E04H 17/003; E04H 17/161; E04H 17/163; E04H 17/165; E04H 17/166; E04H 17/168
See application file for complete search history.

(56) References Cited

U.S. PATENT DOCUMENTS 3,204,606 A * 9/1965 Parr ..... A01K 3/001 16/236
3,385,567 A 5/1968 Case et al.
3,734,467 A 5/1973 Weeden ..... E04H 17/163 256/65.04
3,767,167 A * 10/1973 Rasmussen ..... A01K 1/0005 256/73
3,770,245 A 11/1973 Murdock
(Continued)

FOREIGN PATENT DOCUMENTS

DE 1281474 B * 10/1968 ..... E01F 13/022
EP 1398433 A2 * 3/2004 ..... E04H 17/163
(Continued)

*Primary Examiner* — Matthew R McMahon
(74) *Attorney, Agent, or Firm* — Advitam IP, LLC

(57) ABSTRACT

An enhanced security fence for use in high security situations is provided. The fence is made of high strength materials that are preferably welded together in a convenient, location and sent as prefabricated sections to the installation location to form an all welded bracket-less perimeter barrier fence system. Posts with section hangers are provided and installed at a perimeter, and the prefabricated panels are quickly and securely attached to the posts. The panels can be friction fit to the posts and, if desired welded thereto. The invention includes a method of creating an enhanced security fence, that includes prefabrication of panels and rapid, fitting and securing the panels to posts to more quickly create a secure perimeter in places having difficult environments.

8 Claims, 11 Drawing Sheets

(56) References Cited

U.S. PATENT DOCUMENTS 3,921,585 A * 11/1975 Hall ..... B60P 3/04 119/512
4,371,148 A * 2/1983 Harden ..... A01K 1/10 256/25
4,685,656 A * 8/1987 Lee ..... E04H 17/16 256/19
4,787,475 A * 11/1988 Arteau ..... E04G 21/3223 256/65.01
4,930,752 A 6/1990 Wolper, Jr.
5,052,846 A 10/1991 Behshid ..... A01K 3/00 403/188
5,213,312 A * 5/1993 MacDonald ..... E01F 13/022 256/73
5,553,648 A * 9/1996 Goharjou ..... E01F 7/00 160/237
5,556,080 A 9/1996 Vise
5,718,414 A 2/1998 Deloach et al.
5,779,227 A * 7/1998 Elkins ..... E04H 17/18 256/26
6,581,914 B2 6/2003 Sotillos et al.
7,347,412 B1 3/2008 Zhu
7,360,754 B2 4/2008 Robbins
7,461,489 B2 12/2008 Herbertsson ..... E04H 17/165 256/22
7,516,946 B2 * 4/2009 Fumagalli ..... E04H 17/163 256/28
7,866,635 B2 * 1/2011 Payne ..... E04H 17/04 256/24
8,387,955 B2 * 3/2013 Ptacek ..... E04H 17/163 256/73
8,631,551 B1 1/2014 Payne
8,910,925 B2 12/2014 Payne
9,187,926 B2 * 11/2015 Machacek ..... E04H 17/163
9,371,642 B2 6/2016 Herbertsson ..... E04H 17/163
9,580,930 B2 2/2017 Sadinsky ..... E04H 17/163
9,822,549 B2 * 11/2017 Gentry ..... E04H 17/18
9,826,710 B1 * 11/2017 McNew ..... A01K 1/0017
10,422,156 B1 9/2019 Morrow ..... E04H 17/1404
2007/0261333 A1 * 11/2007 Behshid ..... E04H 17/161 52/236.9
2008/0006808 A1 * 1/2008 Thompson ..... E04H 17/24 256/45
2008/0185565 A1 8/2008 Major et al.
2009/0321701 A1 * 12/2009 Payne ..... E04H 17/161 256/57
2010/0301295 A1 * 12/2010 West ..... E01F 13/022 256/24
2011/0168963 A1 * 7/2011 Bowman ..... E04H 17/163 228/101
2012/0261632 A1 * 10/2012 Bertucat ..... E01F 13/022 256/26
2013/0001493 A1 * 1/2013 Svedberg ..... E04G 21/3233 52/745.11
2013/0139461 A1 6/2013 Herbertsson ..... E04H 17/163 52/582.2
2013/0214227 A1 8/2013 Salisbury
2016/0083974 A1 3/2016 Meza ..... E04H 17/163 256/24
2021/0032823 A1 * 2/2021 Shipper ..... E01F 13/028

FOREIGN PATENT DOCUMENTS

EP 2418340 A2 * 2/2012 ..... E04H 17/163
FR 2142284 A5 * 1/1973 ..... E01F 13/022
GB 2466876 A * 7/2010 ..... E01F 13/022
WO 2008154676 A1 12/2008

* cited by examiner

ENHANCED SECURITY FENCE AND METHOD OF CONSTRUCTION AND INSTALLATION

RELATED APPLICATIONS

This application claims priority benefit of U.S. application Ser. No. 15/804,500, filed Nov. 6, 2017 and presently pending, which in turn claims the benefit of U.S. Provisional Application Ser. No. 62/419,706, filed Nov. 9, 2016, the contents of each application are hereby incorporated by reference as if set forth in full herein.

FIELD OF THE INVENTION

The present invention concerns barriers used to secure institutions and installations. More particularly the present invention concerns fences, fence systems and the method of construction and installation of such to meet the severe requirements of high tier security protocols.

BACKGROUND OF THE INVENTION

Security has become paramount. From airports to sporting events and shopping mails all eyes are on the safety of citizens as individuals and, groups, events and property. This extends as well to secured government and industrial facilities, military bases worldwide and international borders. Tasked with securing all manner of locations, government agencies, such as the United States Department of Homeland Security (DHS) have issued guidelines for all manner of security systems. Included in these guidelines are the guidance factors for protective fences and barriers used to contain important or targeted facilities and areas in the US and in areas where such facilities are located worldwide.

The first round of defense for a facility or border is a barrier, often in the form of a perimeter fence. Fences are useful in both keeping out unwanted visitors and as well keeping in those who should not be allowed out. While a four foot high chain link fence will keep the neighbor dog out of your backyard, more significant structures with elements able to defeat unwanted egress is typically required in increasing levels of security at such places as factories, prisons, refugee encampments, military bases, government facilities and laboratories, embassies and consulates and housing for heads of state. Fences must be chosen with skill to fit the requirements, location and items or subjects to be protected. Recent events shows that the fence chosen to surround the White House in Washington, D.C. had been more effective as a decorative element than the first step in protecting the president and his family. A factory in a major US city is more likely to be protected so as to keep thieves and spray paint taggers out as opposed to an embassy located in a country having unrest, where the barrier fence is likely to be necessary to the avoidance of at minimum an international incident and in the worst case, an act of war. A nuclear test facility is likely to be more concerned with the ingress of spies, whereas a prison in a suburb of Chicago is more likely to be concerned with the escape of an inmate. A fence surrounding an airport is designed to protect those on the outside from contact with aircraft, while perfecting the level of security for passengers by stopping unauthorized entry into the aircraft from without.

But contrastingly, once an intruder is in, for example, a nuclear facility there is also interest in making sure such an intruder cannot egress; the prison warden would not, want an assault on his fence from outside that allows inmates to flee, a military base or government facility in a foreign land depends on the fence to keep its personnel both within and safe.

Further, in the event of a change in situation, such as the deterioration of foreign relations with a nation in which a facility is located, or a radical change in government, it would be helpful if whatever barrier means is presently in situ could be fortified or quickly replaced by a more formidable barrier.

Fence materials are typically lighter weight and less costly to install than walls and their use is typically made such that the facility behind the fence is not obscured but is visible through the fence, making for a more pleasant landscape. There are, therefore, various degrees of fence protection, ranging from a wooden picket fence, which is primarily decorative or used to mark a boundary, to wooden stockade fences designed to either keep things out or in—protecting small parcels of land, maintaining privacy; to chain link fences with various measures to support their barrier, including various heights of fence, and sharpened elements and/or electrification to keep persons from climbing in a spectrum of minimal to greater protection.

Additionally, the traditional method of building a fence or barrier is to set posts at required distances, and then assemble the fence in situ—by assembling, typically with fasteners, fence rails, support members, bars, chain link or other mesh products and gates. Such a system is time consuming and can expose the contractor to dangers depending on the location where the fence is placed—such as in or near a war zone or on a boarder with a hostile nation. Time is of the essence in creating such fences, and the typical methods of assembly-in-place consume enormous amounts of time and typically the fence or barrier is at risk all the time the assembly process progresses. The assembly time is also costly in man-hours which may be charged at an hourly premium due to the conditions present during installation.

Typically, however, fences and barriers are costly, at any level, and take time to design and install and changing to another form of fence or barrier as required, is difficult, costly and time consuming.

It is therefore desirable to protect all of these facilities, and others with barriers made of fence materials, as opposed to walls, of the variety and security appurtenant to the facility. By implementing a Rapid Deployed Post System into fences will allow the post to be place behind the barrier wall for added security and will be able to move the post distance in the field because of unforeseen or underground utility conditions. It is also desirable to be able to upgrade the protection as the threat or need arises. It is desirable to be able to place a fence in a location quickly and with strength to secure a facility or location in as little time and as economically as possible.

It is therefore an object of the present invention to provide a means for more quickly install a level of barrier protection appropriate to the facility and threat present and then to quickly upgrade or remove and replace such a barrier with a more secure perimeter. Further, the reduction of threat raises the concomitant issue of quickly reducing an imposing barrier with a more friendly barrier should a threat diminish or diplomacy call for a more open appearance.

Other objects and advantages of the present invention will become apparent as the description proceeds.

While the present invention is susceptible of embodiments in various forms, there is shown in the drawings and will hereinafter be described some exemplary and non-limiting embodiments, with the understanding that the present disclosure is to be considered an exemplification for the invention and is not intended to limit the invention to the specific embodiments illustrated. In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

SUMMARY OF THE INVENTION

In accordance with the present invention, an enhanced security fence is provided having a plurality of posts; a plurality of prefabricated sections fitted together to form a perimeter, each section comprising: at least one mesh panel; at least a first cross member and a second cross member configured to hold the at least one mesh panel therebetween; a first side member and a second side member; and means to permit the plurality of prefabricated sections to engage one another, and engage the plurality of posts, in at least a friction fit, with no exposed fastening members, to form a fence. In a preferred embodiment, the prefabricated sections are welded to the posts and one another. To provide enhanced security the mesh panels, side members and cross members are made from high strength metal. In a preferred embodiment, the metal is steel. In other embodiments, mesh panels, side member and cross members are made of high strength alloys. To create the fence the prefabricated panels are attached to the posts by fasteners.

An enhanced security fence then is made of a plurality of posts and a plurality of prefabricated sections fitted together to form a perimeter. Each section comprising at least one mesh panel; at least a first cross member and a second cross member configured to hold the at least one mesh panel therebetween, the first cross member forming the upper edge of the section and the second cross member forming the bottom edge of the section; a first side member and a second side member. The first cross member and second cross member and the first side member and the second side member being welded together to form a rectangle with the at least one mesh panel welded therewithin to form a panel; and means to permit the plurality of prefabricated sections to engage one another, and engage the plurality of posts, in at least a friction fit, with no exposed fasteners, to form a fence.

In preferred embodiments, the at least one mesh panel is two mesh panels; the enhanced security fence includes a vertical support member bisecting a horizontal axis of the panel and being attached to the first cross member and the second cross member, the two mesh panels being welded to the side members, the cross members and the vertical support. The at least a first cross member and a second cross member are four cross members one placed at the top of the panel, one placed at the bottom of the panel, one at ⅓ of the height of the panel and one at ⅔ the height of the panel. The side members comprise one each of a Tee-rail and a C-rail. The members being made to allow the placement and secreting of wiring in the fence to provide electronic and electrified features to the fence.

The invention includes a method of creating an enhanced security fence including the steps of providing a plurality of posts; prefabricating a plurality of panels, the panels comprising at least strengthened rails, angle irons, and steel mesh, the rails and angle irons formed into a rectangular shaped structure with the steel mesh held therewithin to form a panel; securing the plurality of posts along a perimeter; and attaching each of the plurality of panels adjacent to and between at least two of the plurality of posts by at least a friction fit.

In preferred embodiments of the method, the panels are created by welding the rails, angle irons and mesh together. In a preferred method the panels are attached to the posts by welds, creating an all welded, bracket-less perimeter barrier fence system. The method of creating an enhanced security fence includes that the friction fit is enhanced by the weight of the fence elements and the rails, angle irons and mesh are created from high strength materials. Further, the attachment of the posts is done rapidly to quickly provide the fence.

In one form, the invention is a security fence that is mostly factory prefabricated so it can be more efficiently and quickly site installed. It eliminates access to fasteners to persons located outside the fence and uses primarily welds to enhance security to minimize the threat of terrorism or other criminal activity. In one form of the invention, the security fence is categorized as Tier 1. For example, typical applications include, but are not limited to, a nuclear facility, a military center or port, a fuel or power generating facility, or a terrorist holding facility. The Tier 1 classification anticipates various attacks such as rocket-propelled grenades, automatic weapons, chemical explosions, crash vehicles, boats, missiles, power cutting and climbing tools, etc. In one form of the invention, the present invention is classified as Tier 0, which provides even greater security to the enclosed area than Tier 1. The Tier 0 form of the present invention completely eliminates the normal use of fasteners and uses all welds not accessible to persons located outside the fence. Typical applications for Tier 0 may overlap with the applications listed for Tier 1, but enhances overall security. It is also possible that both these forms can be used in other applications. For example, a sensitive manufacturing facility, a fuel storage area, an embassy, a chemical storage facility, or a weapons facility just to name a few possibilities. Other applications include, but not limited to, an aircraft facility or parts storage, a fuel truck storage, a water facility or tower, a correctional facility, a prison, or a stadium. Further applications include, but are not limited to, a park or recreational area, an education facility, a commercial property, industrial areas, etc. For both Tier 0 and Tier 1, an option for further security enhancement is to use a security mesh with an additional layer of sharp metal objects protruding from the fencing lattice structure. For example, this is an effective option to enhance security against climbing.

One benefit of eliminating access to fasteners to persons located outside of the fence and using primarily welds is to maximize restricted access. Without having physical ability to access or reach these fasteners and eliminating excess fasteners with the welds, a person cannot tamper with the invention thereby enhancing overall security. Another benefit of restricting access to the fasteners and using primarily welds is improving the speed and quality of installation. By limiting the installation to one side and implementing prefabricated welds, there is a higher tolerance between components during installation, which equates to less vulnerability for error. Additionally, opposed to other products available on the market, the present invention does not require typical fencing brackets, hangers, straps, or bands, thereby further enhancing security and installation. By limiting installation to one side, primarily using welds, and not requiring typical fencing brackets, hangers, straps, or bands, more panels can be installed in one day by the same or even less manpower than existing. For example, using one form of the current invention it is possible for a team to install sixty panels in one day versus twelve panels installation with the same team installing existing third party available product. This equates to approximately a 5 to 1 or 4 to 1 ratio for advanced speed install.

A more detailed explanation of the invention is provided in the following description and claims and is illustrated in the accompanying drawings.

DETAILED DESCRIPTION OF THE ILLUSTRATIVE EMBODIMENT

Figure 1:
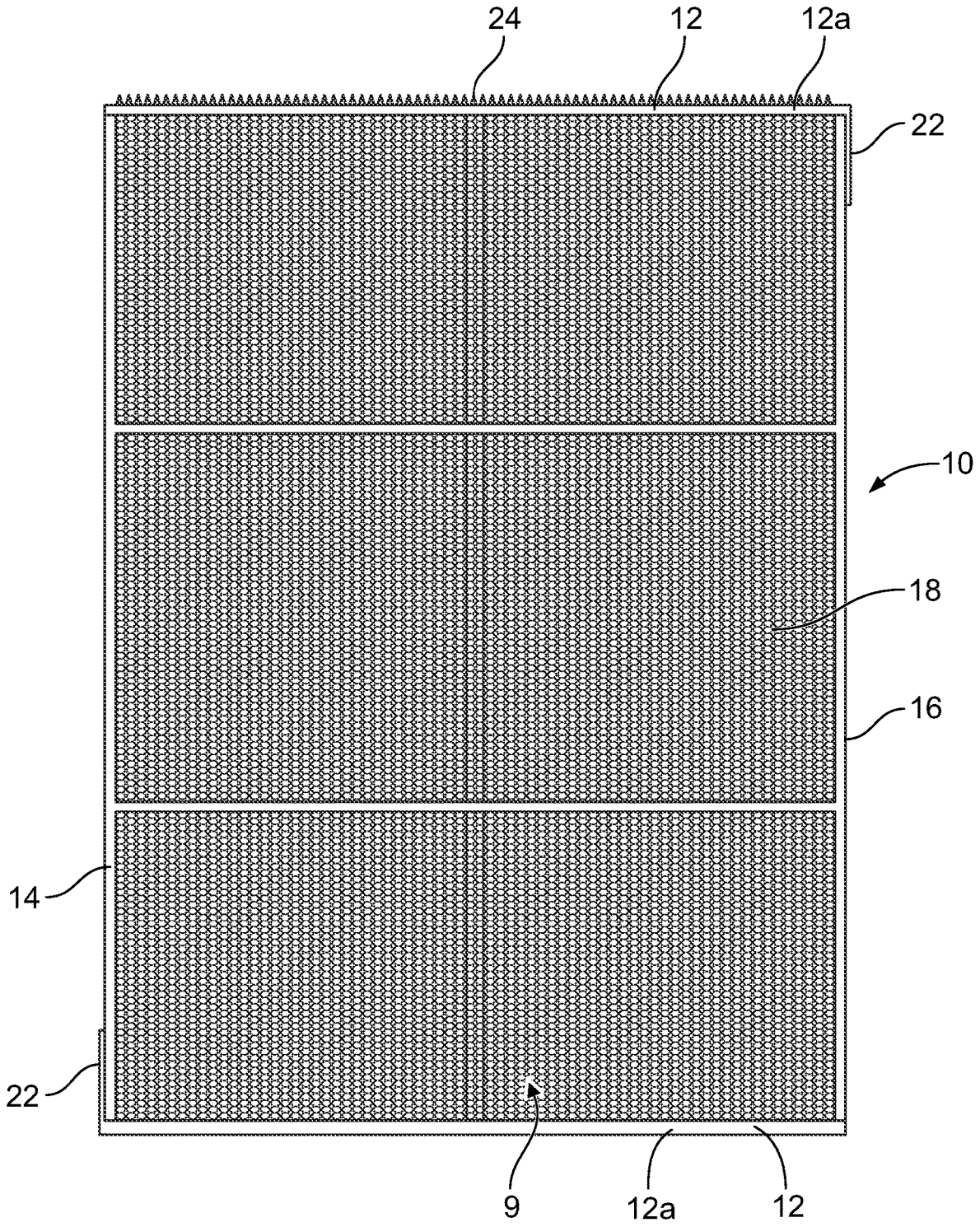
FIG. 1 is an elevational view of a fence panel of made in accordance with the teachings of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Referring to the drawings, a fence panel 10 for use in an enhanced security fence 8, made in accordance with the teachings of the present invention is shown is in FIG. 1. It will be understood by persons having ordinary skill in the art that fence panel 10 is one of any number of panels that when assembled together, as will be explained below, will provide a perimeter defense for whatever is within the fence 8 so formed. Panel 10 is constructed of at least hardened steel members and elements and assembled, and tested so as to meet the requirements of US Homeland Security specifications. Fence panel 10 is shown in an exploded view in FIG. 2 so that the elements used to create the panel can be more easily identified. It will be understood, by persons having ordinary skill in the art, that all of the elements of the fence panels shown and described and elements of the fences shown and described can be made from various materials, comprising metals and alloys, to prescribed strengths for various uses of the fences shown, without departing from the novel scope of the present invention. The use of many diverse materials is anticipated, in the present invention to accommodate price, availability of materials, strength and weight characteristics and ease of manufacture and installation.

Figure 2:
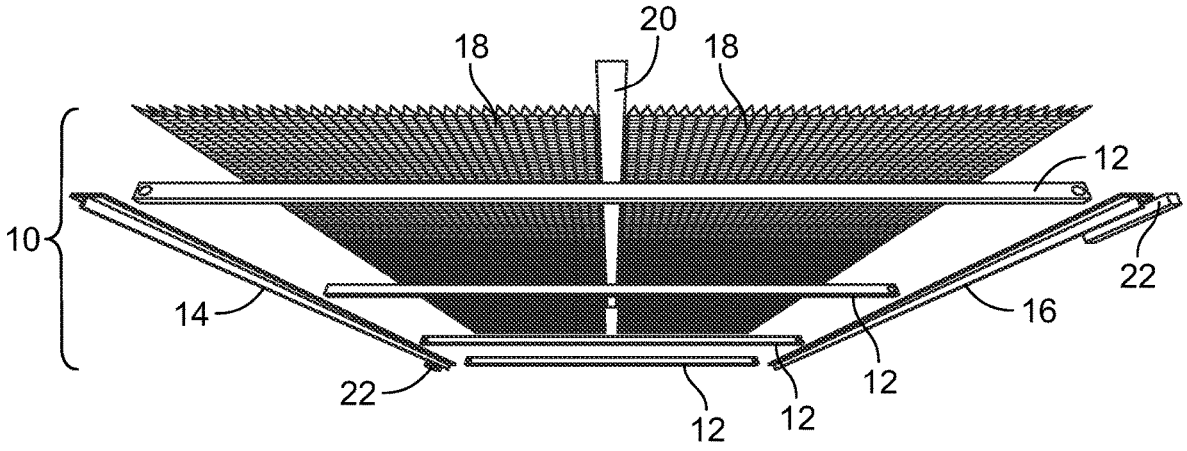
FIG. 2 is an exploded view of the fence panel of FIG. 1.
Figure 3:
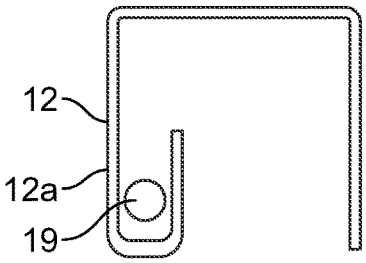
FIG. 3 is cross-sectional view of a C rail, labeled "12", in FIG. 2.

Referring to FIG. 2, it will be seen that in the illustrative embodiment, fence panel 10 comprise four channel, or "C", rails 12, spaced apart starting at, and framing, the top and bottom of fence panel 10 and providing support at approximately ⅓ and ⅔ of the height of panel 10. FIG. 3 shows a cross-sectional view of a rail 12, to aid in the understanding of the strength provided by rail 12 to the overall panel 10 and fence being created. The use of a "C" rail configuration for rail 12, provides a strengthened rail, as is known in rolled steel applications, to anchor the horizontal expanse of the panel, while creating a clean aesthetic for the outward facing element 9 of the fence. It will be seen that, rail 12 vertical element 12*a* comprises a prominent element of the exterior face of fence panel 10. Persons having ordinary skill in the art will understand that the placement of the rails 12 is done to afford the greatest strength and stability for the panel, but that other arrangements of the rails 12, using more or fewer rails, and/or placing them in different relative positions to the height of the panel, is contemplated in the present invention, in order to allow for such things as portals or doorways in desired locations, to accommodate features of the landscape and or to offer a panel, having more rails 12, to provide greater strength is specific locations. It will be understood that the drawings and description are for illustrative purposes and are not meant to be limitations on the numerous variations in the placement of elements in a panel or fence.

Figure 4:
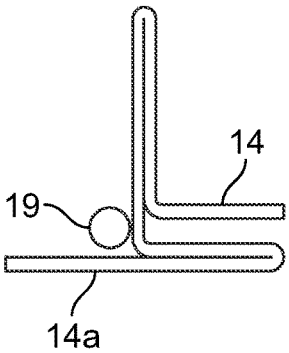
FIG. 4 is a cross-sectional view of a Tee rail, labeled "14", in FIG. 2.
Figure 5:
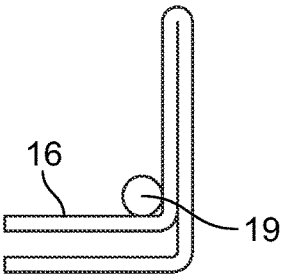
FIG. 5 is a cross-sectional view of an angle iron, labeled "16", in FIG. 2.

Referring again to FIG. 2, it will be seen that panel 10 additionally comprises side rail 14, comprising a Tee rail as shown in FIG. 4. Similar to C-rails 12, Tee rails 14 are formed in a T-shape to provide the needed strength in the vertical direction for the fence panel 10. It will be seen, both in FIG. 1 and FIG. 2, that Tee rail 14 is utilized on the left side of panel 10 (as it is viewed in FIG. 1) and that the right side of panel 10 has an angle iron 16 thereon (shown in cross-section in FIG. 5), to provide the vertical strength to fence panel 10. The use of the different shaped members "B" and "C" in the drawings allows for one panel 10 to be assembled adjacent to another panel 10, with the "T" element of the member "B" overlapping the side having the "C" element producing a flush surface showing the flat "T" surface 14*a* covering the seam between the elements (see FIG. 8). It will be understood that the relative positions of T-rails 14 and angle irons 16 can be reversed without departing from the novel scope of the present invention, but that the use of these different elements provides the means to assemble many panels 10 side to side without having an unnecessary and clumsy overlap of material, as can be seen in the drawings.

Figure 6:
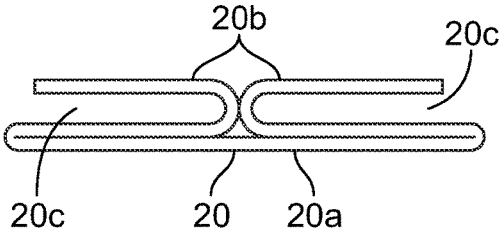
FIG. 6 is a cross-sectional view of a flat bar strip, labeled "20", in FIG. 2.
Figure 7:
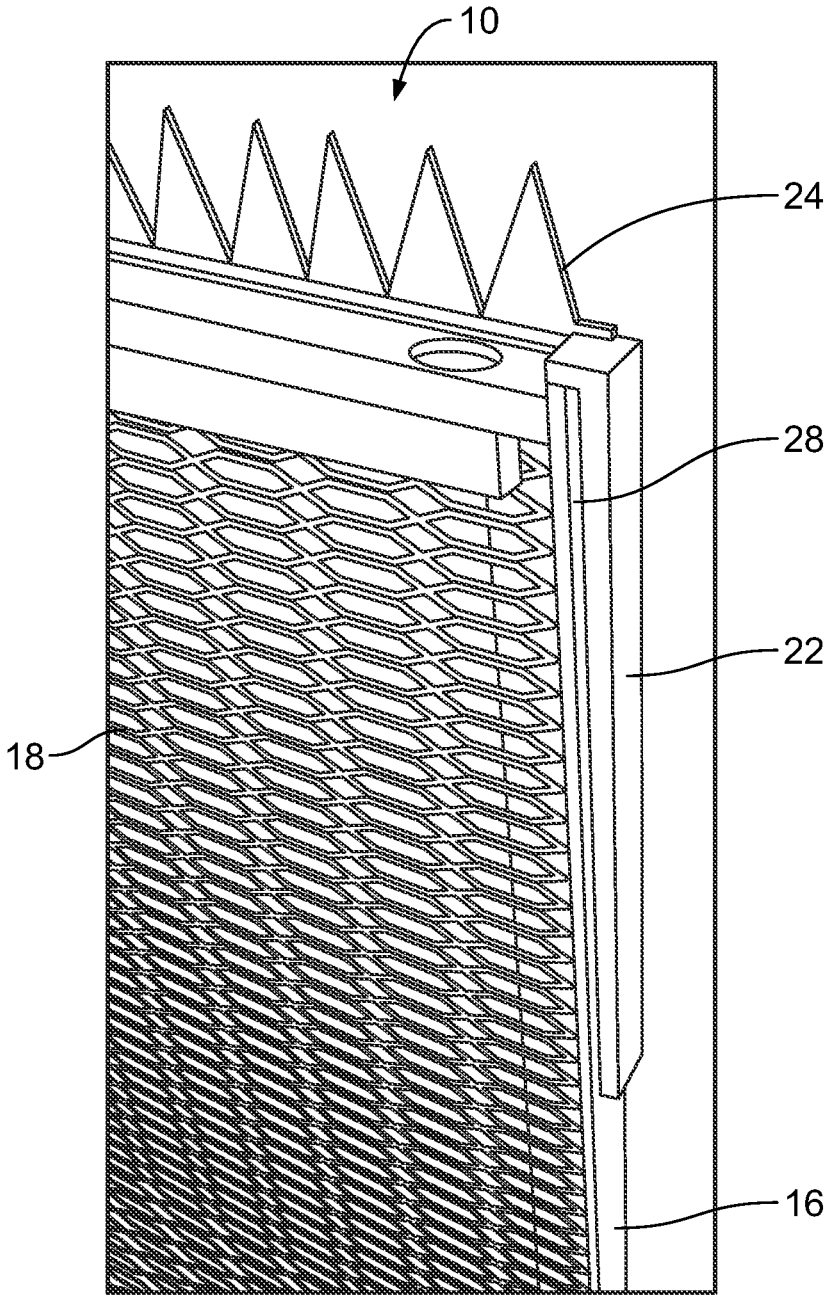
FIG. 7 is a cut-away perspective view of a flat bar, labeled "22" and mesh labeled "D" in FIG. 2.

In most of the figures showing the fence panel 10, it will be seen that a metal mesh 18 is used to form the major component of the fence panel 10. Referring to FIG. 7, metal mesh 18 is shown more closely. It will be understood, by persons having ordinary skill in the art, that such mesh can be produced in a number of effective ways, including punching, die cutting and weaving. In addition, it will be understood that other mesh or fabric can be used to create the body of the panel 10 without departing from the novel scope of the present invention, and that the mesh 18 shown is effective and useful for illustrative purposes. In FIG. 2 mesh 18 is shown as being made in two pieces in panel 10, with a flat bar strip 20 placed between mesh 18 pieces. Referring to FIG. 6, flat bar strip 20 is seen as a cross-section, where surface 20*a* provides an area onto which mesh 18 can be attached through for example, welding or the use of fasteners, as will be discussed below. Additionally, the legs 20*b* provide a space 20*c* into which mesh 18 sections can be placed and then attached providing a further strengthened joinder of the structural and mesh elements of the panel. It will be seen that many of the structural elements used to create panel 10 comprise folded sections that can be used to conceal and protect wiring 19 for power or for sensors along and within the panels 10 so as to, in certain embodiments of fences and barriers made in accordance with the present invention, provide illumination, electrification and sensor information relative to portions of the fence or barrier being touched, attacked or breached to a central monitoring location and/or to provide alerts as designed. In a preferred embodiment, the unique design of the C-rail allows for a fibrotic cable (also known as shaker cable) to be rapidly deployed without any additional fasteners.

Referring again to FIG. 7, which was used to illustrate mesh 18, it will be seen that panel 10 also includes a flat bar 22 at the perimeter of the panel, in FIG. 7 attached to angle iron 16, near the top edge of angle iron 16 and a crown element 24, used to discourage climbing of the fence. In a similar fashion, a flat bar 22 is also attached at the bottom surface of each Tee rail 14 (as shown in FIG. 2). Flat bar 22, in the illustrative embodiment comprises an "L" shaped member wherein the shorter leg of the "L" 22*s* is attached to one of the angle iron 16 or Tee rail 14 (as noted above) creating a space 28 then between flat bar 22 and the angle iron 16 or Tee rail 14 adjacent thereto. Persons having ordinary skill in the art will understand that flat bar 22 can be attached to rails 14, 16 in any acceptable manner, welding being the most efficacious joining possible and therefore the preferred method. In the preferred embodiment, panels 10 of the fence would be created to be about eleven feet tall and about eight feet wide; flat bar 22, in a preferred embodiment would be about 1 foot long with the gap formed between bar 22 and rail being less than one inch, and being made such that rails 14, 16 comprise an attaching element (as shown in the cross-sectional figures) of a similar girth such that, as will be described below and in conjunction with FIG. 8, when two panels are attached together with flat bar 22, the fit is substantially snug. It will be understood that such a fit, along with the mass of the panels 10 and supports (discussed below) will hold the fence panels together to form an appropriate barrier wall; however, it is conceived of that in certain situations, the fit of flat bar 22 and rails 14, 16 will be more permanently made by affixing the elements together, either by welding or with fasteners or both.

Figure 8:
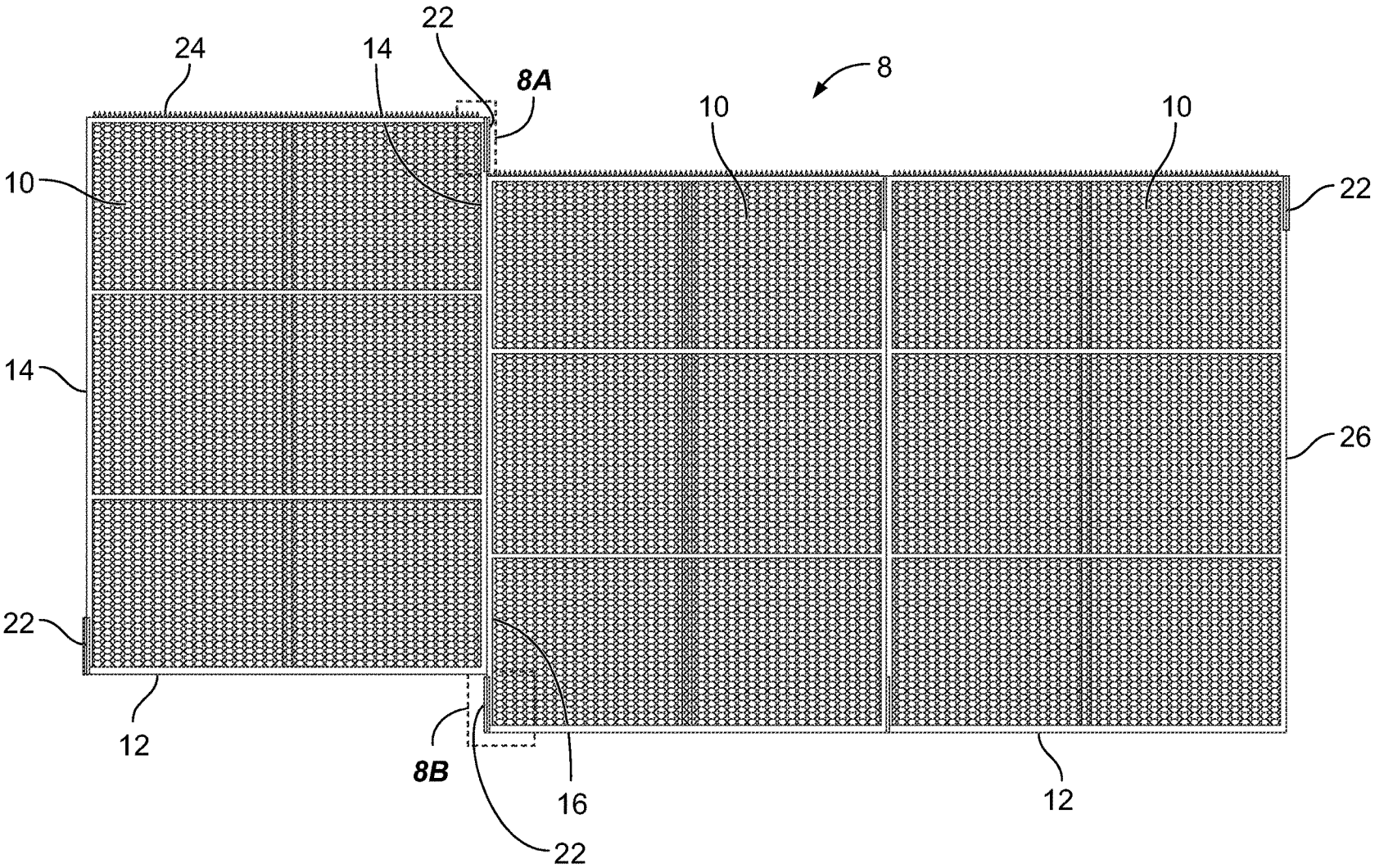
FIG. 8 is an elevational view of three fence panels, as shown in FIG. 1, in working assembly and being installed.
Figure 8A:
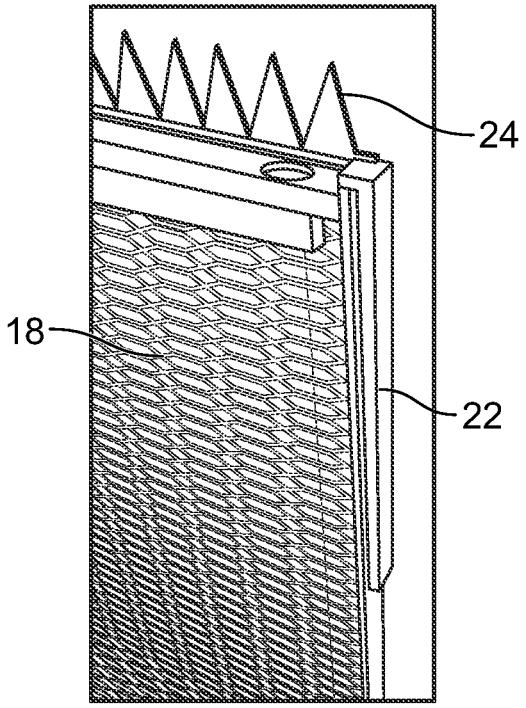
FIG. 8A and FIG. 8B are exploded views of the detail of the fence panel flat bar in position and assembly.
Figure 8B:
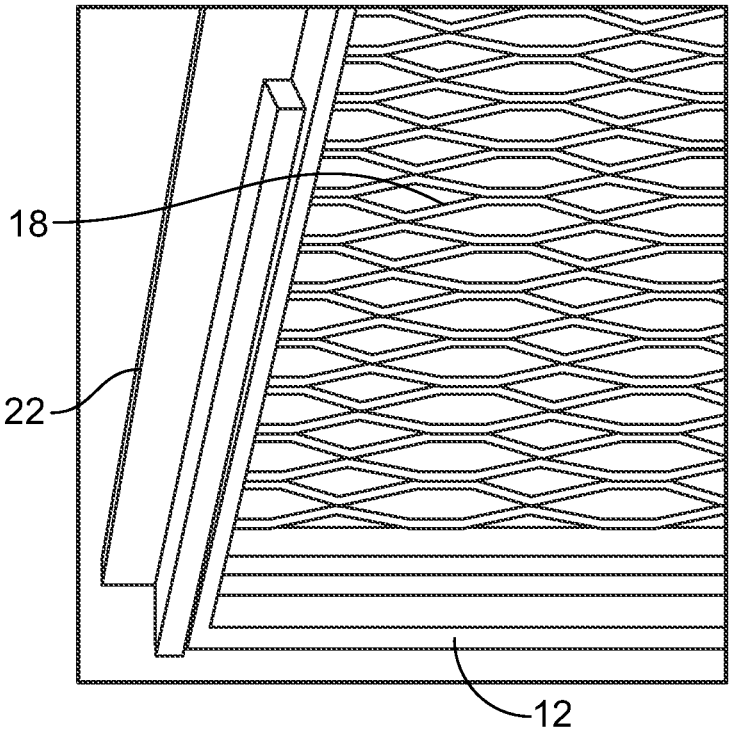

Referring now to FIG. 8, a configuration of three panels is shown to illustrate a segment of fence, or barrier, created by the assembly of the panels 10. As shown, a panel that is in place (attached to posts, as discussed below) becomes the anchor for the next panel 10, which is lowered into place such that, as illustrated, rail 16 of the new section and rail 14 of the places placed section are slid together such that rails 14 and 16 engage spaces 28 in flat bars 22 (one flat bar 22 per panel 10 side-rails 14 having a flat bar 22 at its lower extremity and rails 16 having a flat bar 22 at its upper extremity), locking the panels together. The final rail 26, at the right side of the figure being an angle iron. It will be understood that the weight of each panel may be sufficient in some situations to hold the panel together, however, as will be understood, once the panels are in place the connections can be over welded to enhance the connection of the panels.

Figures 9, 9A, 9B:
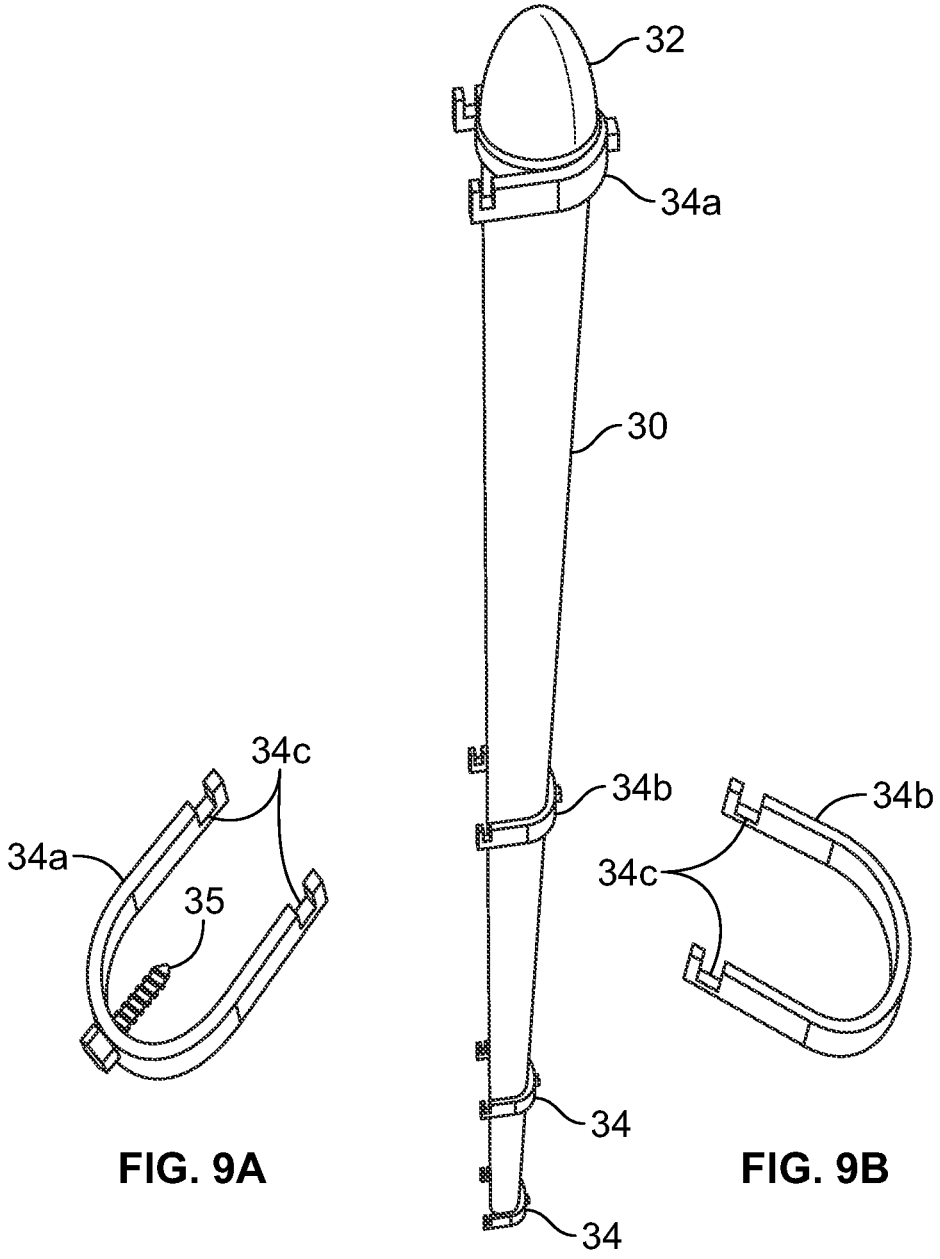
FIG. 9 is a perspective view of a pipe of the type used to support the fence of the present invention, with panel support members thereon.
FIG. 9A and FIG. 9B are exploded perspective views of panel support members as shown on FIG. 9.

Referring to FIG. 9, a typical post 30 used to anchor the fence panels 10 is shown having hangers 34. It will be seen that the posts are typically placed into the ground and anchored with concrete, in a manner well known to persons having ordinary skill in the art. Post 30 and hangers 34 are preferably made of hardened structurally significant materials to provide a very strong anchor for the fence panels when in situ. In addition, post 30 can be provided with a cap 32 which protects the interior of the post 30 and anything within the post, such as wires 19, from weather or access by persons seeking to defeat the fence. FIGS. 9A and 9B show hangers 34 used to connect panels 10 to posts 30. As can be seen FIG. 9A shows a hanger 34*a* having a fastener 35 therein, in installation, the hanger being placed on the post and with the fastener, such as a metal screw, being driven in the post to keep the hanger in place. Alternatively, FIG. 9B shows a hanger 34*b* that has no fastening means and therefore is welded to post 30 at the appropriate place. It will be understood that hanger 34*a* could be fastened into post 30 and then welded to add further strength to that connection. A theme throughout the description of the present invention has included the use of welds so that fasteners are not used in creating the fence of the present invention so that those interested in defeating the security elements of the fence by disassembling fasteners would be thwarted. This all welded bracket-less perimeter barrier fence system will be seen as an improvement of the security of such fences and barriers over the existing art, in that the fence of the present, invention cannot be disassembled using hand tools.

Figure 10:
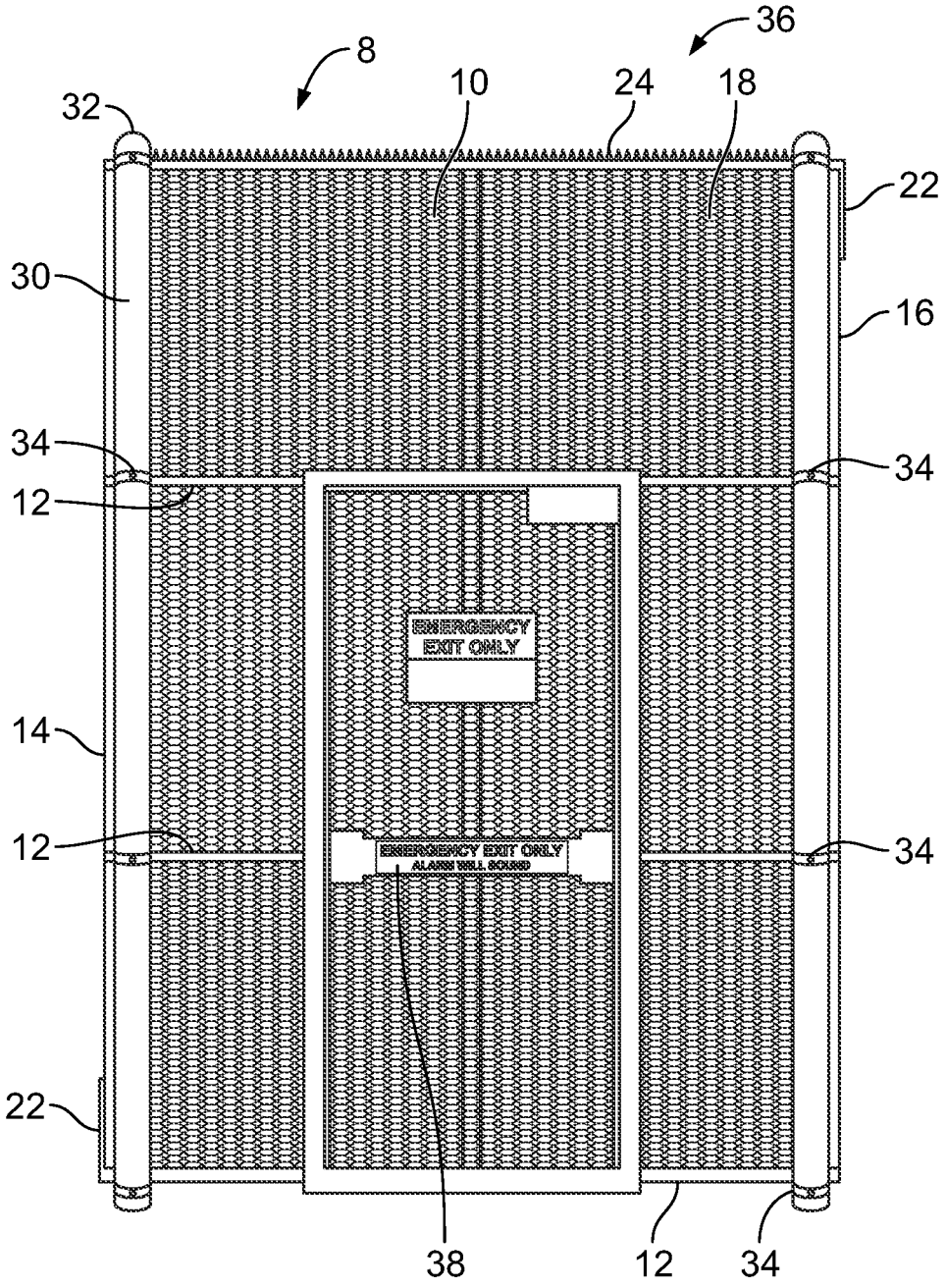
FIG. 10 is a rear elevational view of one type of fence panel made in accordance with the present invention.

Referring to FIG. 10 an exemplary complete fence segment 36 of fence 8 is shown. As will be seen, segment 36, includes a panel 10 comprising rails 12, side rails 14 and 16, mesh 18, flat bar strip 20 (not shown as it is behind mesh 18 in the upper area above door 38), flat bar 22 and crown 24. In addition, segment 36 includes a secure locking door 38, shown here to illustrate the manner that a portal can be placed in such a fence 8. It will be understood by persons having ordinary skill in the art that normal ingress and egress means found in fences, such as gates, can be included in the present invention without departing from the novel scope thereof. FIG. 10 provides a view of the connection between post 30 and a fence segment 36. It will be seen that two posts 30 are provided for segment 36 and that the posts are set within the perimeter of segment 30 such that rails 14 and 16 of panel 10 are located outside of posts 30. Hangers 34, as shown here and in FIG. 9, comprise a horseshoe shaped element having connecting slots 34*c* at their distal ends. Slots 34*c*, as shown in FIG. 10 engage rails 12, with a sliding friction fit, to hold panel 10 to posts 30. It will be seen that there is one hanger 34 per rail 12 on each post 30 to engage the illustrative example in four places per post. It will be understood that the friction fit, in association with the weight of panel 10 and the connection via side rails to flat bars 22 at each side, provides a very significant and integrated force to keep the fence together and allows for quick assembly at the site of the perimeter to be protected. Persons having ordinary skill in the art will understand that such a fence can be constructed and remain in this state for its life, can be constructed and immediately have each connection show in this description welded or can be constructed and then as time permits, or security interests require have some or all of the elements welded together to upgrade the protection when needed.

It will be understood by persons having ordinary skill in the art, that by prefabricating the panels the actual assembly of a fence at the site, can proceed with rapidity such that a facility or location can be quickly secured. This is particularly useful in situations where the security of a particular site has changed quickly. It is envisioned that the fence of the present invention can be assembled with friction fits to provide a very secure situation immediately, and then the panel can be further welded to the posts to secure the perimeter further and do so at a more relaxed or safer rate after the initial installation.

When the elements noted above are assembled together they result in a panel 10 being formed as shown in FIG. 1. In a preferred embodiment, panels 10, sufficient to cover the perimeter of a location to be fenced in, are assembled in a safe site, such as in a factory, and are shipped ready to assemble to the site to be encircled. It will be understood that the elements making up panel 10 can be assembled using fasteners in the traditional manner, but in the preferred embodiment the elements are welded together. Welding provides a strengthened assembly, when compared to fasteners and, as will be understood, cause the fence to be able to withstand attempts to break in (or out) by disassembling the fasteners. In situations where fasteners have been used in the past, the fasteners are typically placed on the side of the fence that is the first wall of defense. So, for example, in a fence surrounding a facility to be protected the fasteners would be placed in the interior of the fence, thereby making the exterior more difficult to breach. In the situation of a prison, for example, escape from the fence being undesirable, the fasteners would be exterior of the fence. This however, presents the situation of exterior force desiring to aid in an escape from the prison (necessitating that fasteners be on neither side of such a fence). For this and other reasons, the use of welds is preferable. In the present invention, the welds would be primarily made in a factory situation and the panels assembled at the site.

Figure 19:
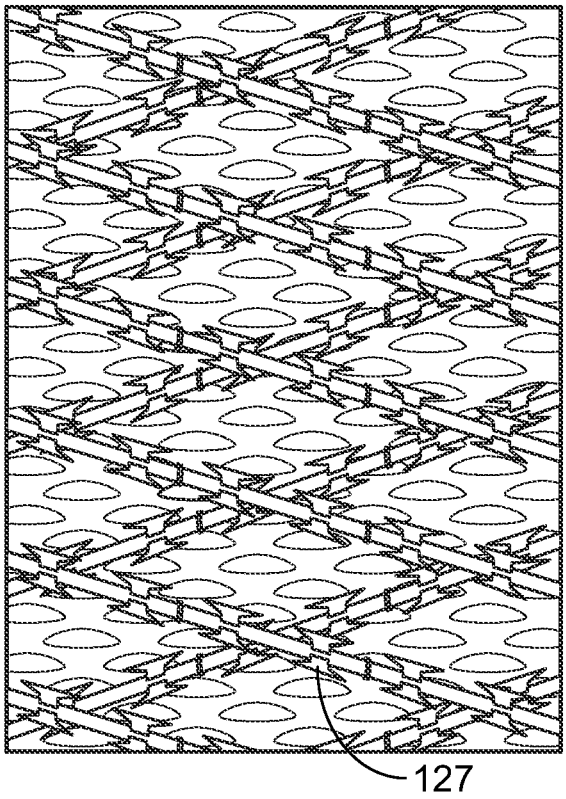
FIG. 19 is an elevational view of additional deterrent elements that can be added to a fence of the present invention.

Additionally, as will be shown in further embodiments below, such a fence 8 can include traditional means to deter climbing such as barbed wire, razor wire 127 (FIG. 19), electrification, surveillance cameras, drone stations, sentry posts and others without departing from the novel scope of the present invention.

Persons having ordinary skill in the art will understand that an enhanced security fence 8 can take many shapes and styles. Disclosure of alternative embodiments of such fences 8 is shown in the following drawing figures being understood that elements of one type fence shown in one figure could be used in other fences shown in the other figures, without departing from the novel scope of the invention. During fabrication of another embodiment of the invention 100 (FIG. 11), the fence sections are sized in the factory and assembled by welding all components (post 111, channels 112, palisade pickets 113 and security mesh panels 114) before delivery to the installation site. In a desired application, the security mesh panels 114 may contain a layer of sharp metal objects protruding from the fence lattice structure (see FIG. 19) to further enhance anti-climb security. The security mesh panels 114 may be field cut, but this is very seldom required. The steel channels 112 are pre-welded horizontally to the inside perimeter of the specified security mesh panels 114 with all weld points located on the inside perimeter. With a specified space in between, the palisade pickets 113 are pre-welded vertically alongside the security mesh panels on the outside perimeter of the fence with all weld points located on the inside perimeter. The fence posts 111 contain pre-welded slotted tabs 116 to complete assembly at the installation site.

Figure 15:
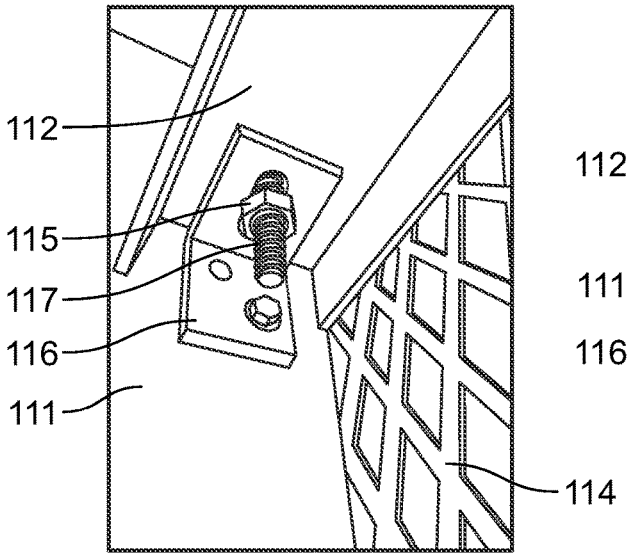
FIG. 15 and FIG. 16 are enlarged views of the connector of FIG. 14 in place on a fence.
Figure 16:
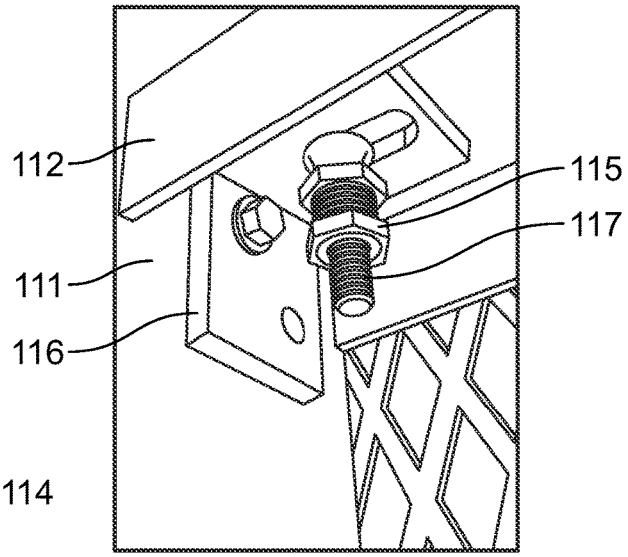
Figure 17A:
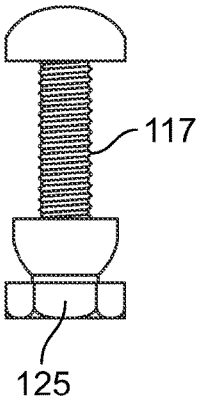
FIG. 17A and FIG. 17B are elevational view of the connector of FIG. 14 shown alone to show how the connector functions.
Figure 17B:
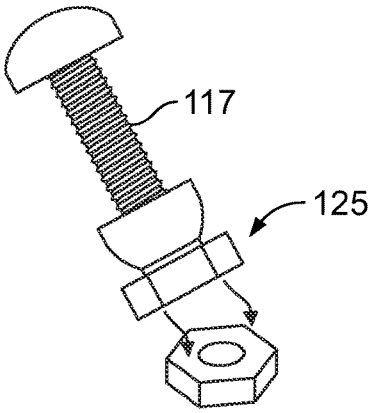
Figure 18:
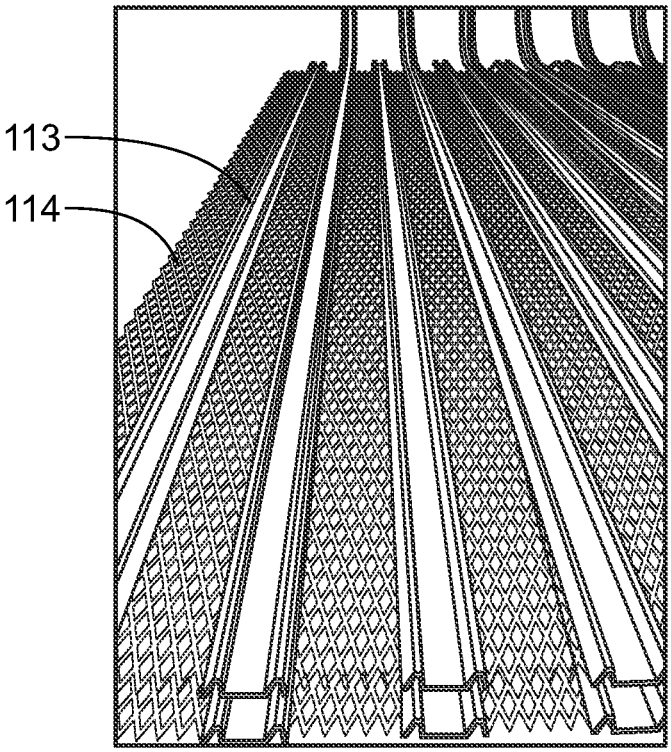
FIG. 18 is an elevational view of a fence panel of the present invention.

During installation, of one embodiment of the invention 100 (FIG. 11), the fence posts 111 are installed at the perimeter of the area to be fenced. In one embodiment as shown in the attached drawing figures, the pre-welded sections 120 (FIG. 12) are fastened to the posts 111 at pre-welded slotted tabs 116 (FIG. 15 and FIG. 16) using bolts 117 with nuts 115 and breakaway nuts 125. The bolts/breakaway nuts 117, 125 are located on the pre-welded fence 100 at the site interior side so they cannot be accessed from someone on the outside of the fence perimeter (FIGS. 15-16). The bolts/breakaway nuts 117, 125 are comprised of a one-way bolt and a breakaway nut (FIG. 17). The pre-welded channels 112 are aligned to and placed on the pre-welded slotted tabs 116. As stated previously, this alignment has a greater clearance for better and faster installation. The one-way bolts and breakaway nuts 117, 125 fasteners are tightened to the pre-welded slotted tabs 116 using the slots, which provide that clearance for alignment. The fasteners must be tightened until the head of the one-way bolts/breakaway nuts breaks off (see FIGS. 17A and 17B), which further enhances security because this process eliminates the portion to loosen the fasteners. Therefore, even if persons located on the outside perimeter of the fence gained access to these fasteners, it would be difficult to loosen or remove them.

In another embodiment (FIG. 11) the fence sections 100 can be directly welded to the posts 111. The pre-welded sections 120 (FIG. 12) are directly welded to the posts 111 to further strengthen the connecting points, thereby farther enhancing security. In this embodiment, the bolts/breakaway nuts 117, 125 and the angled slotted brackets 116, previously disclosed, are not needed. By further reducing the number of components, this embodiment is even less vulnerable to failure and thereby further enhancing security.

Figure 11:
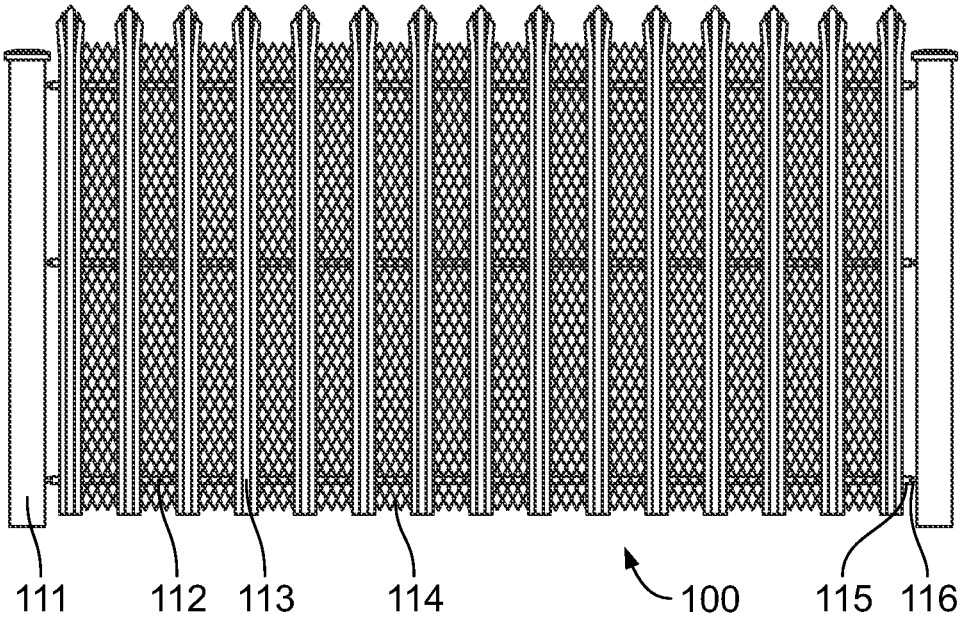
FIG. 11 is a front elevational view of a fence segment made in accordance with the present invention.
Figure 12:
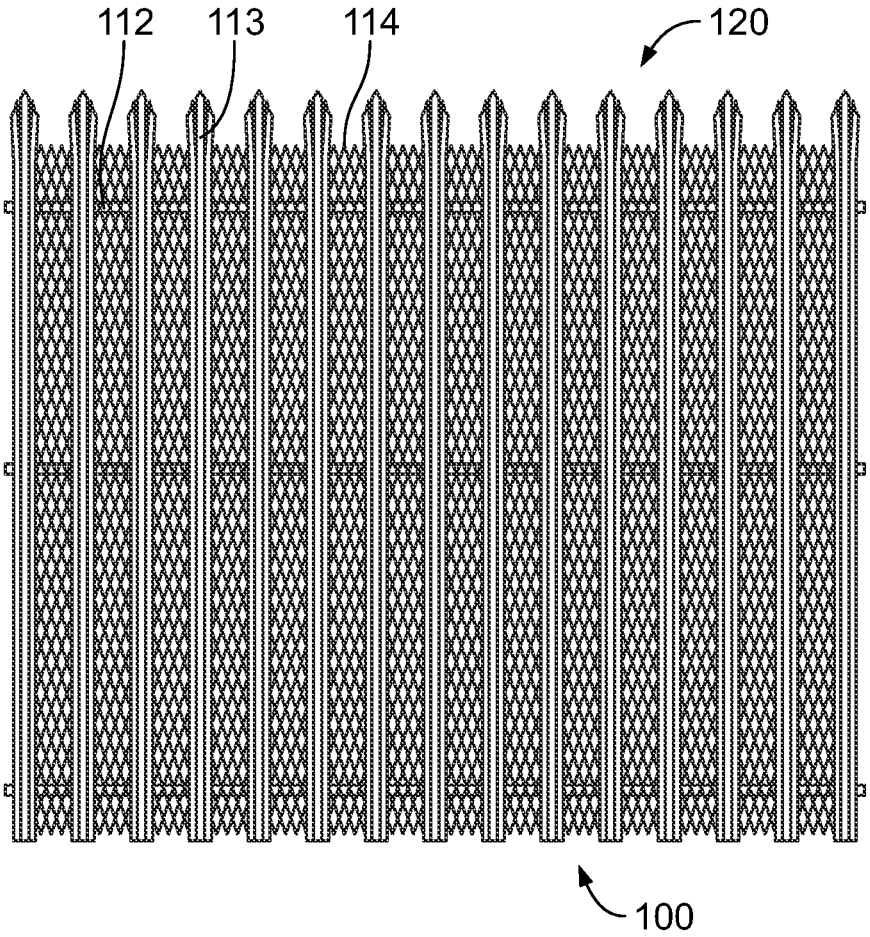
FIG. 12 is a front elevational view of a fence panel of the fence segment of FIG. 11.
Figure 13:
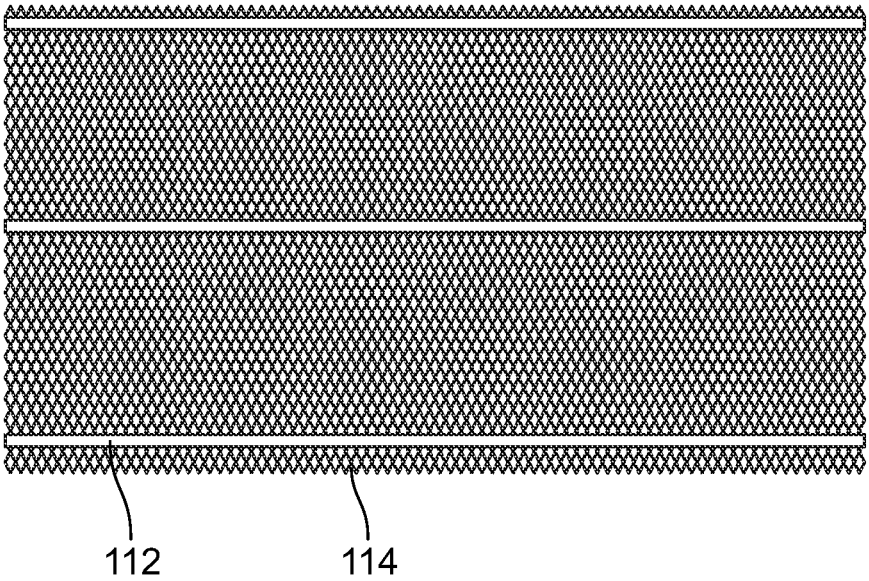
FIG. 13 is a rear elevational view of a fence panel of the present invention.
Figure 14:
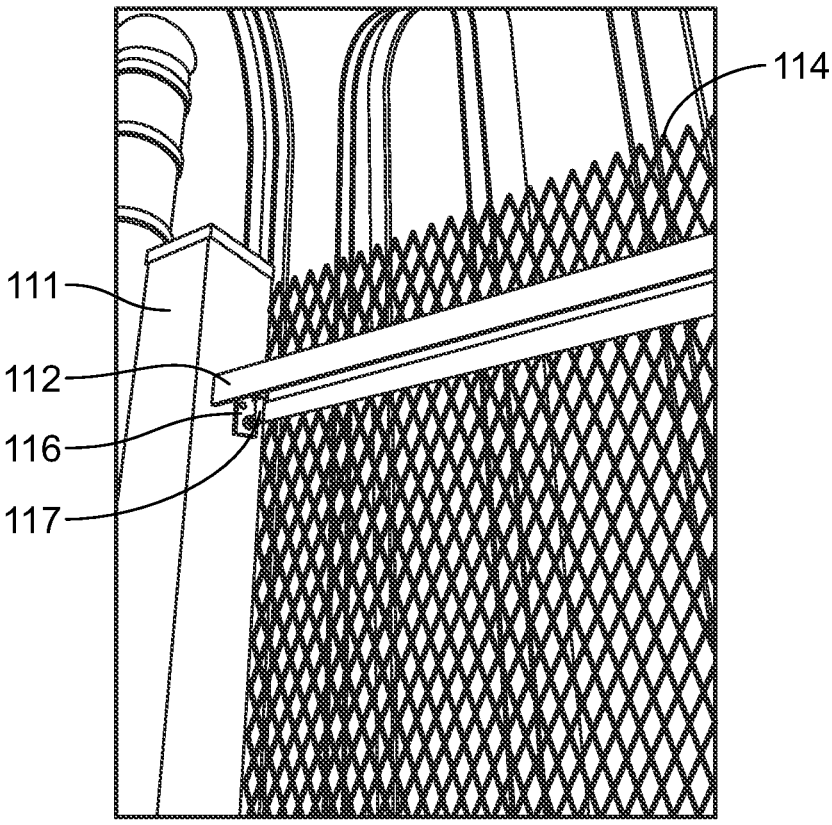
FIG. 14 is a view of a connector used in the assembly of a fence panel made in accordance with the present invention.

In yet another embodiment, the invention is a completely welded and bracket-less fencing system enhancing security and installation. The security fence includes a pre-welded assembly to be installed in the ground at, the installation site (FIG. 11). As shown in FIG. 12, the invention incorporates various posts to rail connections teaching away from traditional brackets used m the field to farther enhance security and installation. All welds and installations are completed by trusted and certified professionals that satisfy all standard requirements and guidelines.

To further enhance security and quality, this embodiment comprises components with durable specifications. After welding, protection is further maximized through a fully immersive galvanized coating process. The galvanizing process incorporates zinc to protect all surfaces, including the interior, against sheering, flame cutting, drilling, and hole-punching. After galvanization, the invention undergoes a tri-treatment powder coating process to eliminate and protect against any material defects such as cracking, peeling, chipping, and corroding. For example, in one example, the tri-treatment process surpassed a 6,000-hour salt spray test with zero failure on the scribe mark. All processes are conducted by trusted and certified professionals satisfying all standard requirements and guidelines.

In addition to its construction, this invention further enhances security and quality by using components with high grade, strength, and finishes. After welding, protection is further maximized through a fully immersive galvanized coating process conducted by certified professionals satisfying and abiding all standard requirements and guidelines. The galvanizing process incorporates zinc to protect all surfaces, including the interior, against sheering, flame cutting, drilling, and hole punching. Thereby, also protecting against any material defects such as such as cracking, peeling, chipping, and corroding.

It is important to reiterate that with each of these embodiments, typical fencing brackets, hangers, straps and bands are not required thereby enhancing security and installation. Security is enhanced because these typical fencing components would be adding to the list of parts that may fail, which increases vulnerability of the entire product. By decreasing the number of parts and removing the use of typical industry components, the present invention is significantly improving industry standards regarding security, efficiency of installation and reduces added expense for parts not required. Furthermore, having additional parts such as the typical fencing components, a security fence becomes vulnerable to installation errors. All of these typical fencing components require more precision during installation because of a lower installation clearance between the components. Thereby not efficiently expending manpower during site installations. As stated previously, the present invention significantly minimizes the precision required during site installations. Thereby effectively and efficiently using manpower to install more units per day. Overall, the present invention further enhances security and expedites installation in comparison to other products available on the market, which is the main interest of a consumer for this type of product.

Specific embodiments of novel methods and apparatus for construction of the Enhanced Security Fence and Method of Construction and Installation according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

Although an illustrative embodiment of the invention has been shown and described, it is to be understood that various modifications and substitutions may be made by those skilled in the art without departing from the novel spirit and scope of the invention.

What is claimed is:

1. A method of creating an enhanced security fence having at least one secure side impervious to disassembly of the fence, including the steps of:

opening a plurality of post holes in a surface;

providing a plurality of posts;

placing the plurality of posts into the plurality of post holes;

anchoring the plurality of posts in the plurality of post holes;

providing a plurality of prefabricated sections slideable together to form a frictionally fitted perimeter, each section comprising:

at least one generally rectangular mesh panel having a top, a bottom, a left side and a right side;

a first structural side member and a second structural side member;

at least two first structural cross members and a second cross member configured, with at least one cross member being adjacent to the top of the mesh panel and at least one cross member being adjacent to the bottom of the mesh panel, to hold the at least one mesh panel therebetween;

the first structural side member and second structural side member each being affixed to the structural cross-members to together form a frame holding the mesh panel therein, the structural side members each having a cooperative engagement flange for slideable engagement of one of the plurality of prefabricated sections with another;

slideably attaching, by at least a friction fit, each of adjacent prefabricated sections together at the cooperative engagement flanges such that the prefabricated sections are snugly fit together and so that adjacent prefabricated sections, when received by the plurality of posts, cannot move laterally relative to one another, forming together a barrier wall, and attaching one or more of the plurality of prefabricated sections to the plurality of posts to form a fence at the perimeter.

2. The method of creating an enhanced security fence of claim 1, wherein the prefabricated sections are created by welding the first structural cross members, the second cross member, and the mesh panel together.

3. The method of creating an enhanced security fence of claim 1, wherein the prefabricated sections are attached to the posts by welds.

4. The method of creating an enhanced security fence of claim 1, wherein the friction fit is enhanced by the weight of the prefabricated sections.

5. The method of creating an enhanced security fence of claim 1, wherein the structural cross members, the side members, and the mesh panels are created from hardened materials including hardened steel and high strength alloys.

6. The method of creating an enhanced security fence of claim 1, including the step of placing and secreting wiring and cables within the side and cross members of the fence to provide electronic features therein.

7. The method of creating an enhanced security fence of claim 1, wherein the structural side members of a first prefabricated section are engageable with a structural side member of an adjacent prefabricated section.

8. The method of creating an enhanced security fence of claim 7, wherein each prefabricated section comprises a first slideable engagement flange and a second slideable engagement flange, one on each structural side member, the first slideable engagement flange being attached adjacent the top of one structural side member and the second slideable engagement flange being attached adjacent the bottom of the other structural side member, such that when adjacent prefabricated sections are slid together in frictional fit, the engagement flanges of adjacent prefabricated sections engage adjacent structural side members.

* * * * *